United States Patent [19]

Mehoudar

[11] 4,449,669

[45] May 22, 1984

[54] IRRIGATION DEVICE

[76] Inventor: Raphael Mehoudar, 36 Yehuda Hanassi St., Tel-Aviv, Israel

[21] Appl. No.: 286,354

[22] Filed: Jul. 23, 1981

[30] Foreign Application Priority Data

Aug. 6, 1980 [IL] Israel ..... 60775

[51] Int. Cl.[3] ..... B05B 1/30

[52] U.S. Cl. ..... 239/533.1; 138/45; 239/570; 239/590.5

[58] Field of Search ..... 239/533.1, 533.2, 533.13, 239/533.14, 570, 590.5, 602; 138/45

[56] References Cited

U.S. PATENT DOCUMENTS

| | | | |
|---|---|---|---|
| 114,337 | 5/1871 | Perry | 239/602 |
| 359,602 | 3/1887 | Gray | 239/602 |
| 2,454,929 | 11/1948 | Kempton | 138/45 |
| 2,941,544 | 6/1960 | Péras | 239/533.14 |
| 2,998,198 | 8/1961 | Young | 239/533.13 |
| 3,072,151 | 1/1963 | Quercia | 239/533.2 |
| 3,080,121 | 3/1963 | Ranhagen | 239/533.13 |
| 3,528,614 | 9/1970 | Hönmann | 239/590.5 |
| 3,612,409 | 10/1971 | Henning | 239/602 |
| 3,776,470 | 12/1973 | Tsuchiya | 239/533.13 |
| 4,058,261 | 11/1977 | Pollart | 239/602 |

*Primary Examiner*—John J. Love
*Assistant Examiner*—Michael J. Forman
*Attorney, Agent, or Firm*—Browdy and Neimark

[57] ABSTRACT

In a water sprinkler device having a nozzle housing and an outlet aperture of said housing; a nozzle unit comprising, a resiliently flexible annular member, a resiliently flexible intermediate tubular portion and a nozzle outlet tube, the annular member merging continuously with the outlet tube via the intermediate tubular portion and defining with the outlet tube and the intermediate tubular portion a continuous bore, the outlet tube extending through the outlet aperture of the housing, the annular member being located within the housing so as to abut a rim of the outlet aperture.

8 Claims, 5 Drawing Figures

IRRIGATION DEVICE

Figure 1:
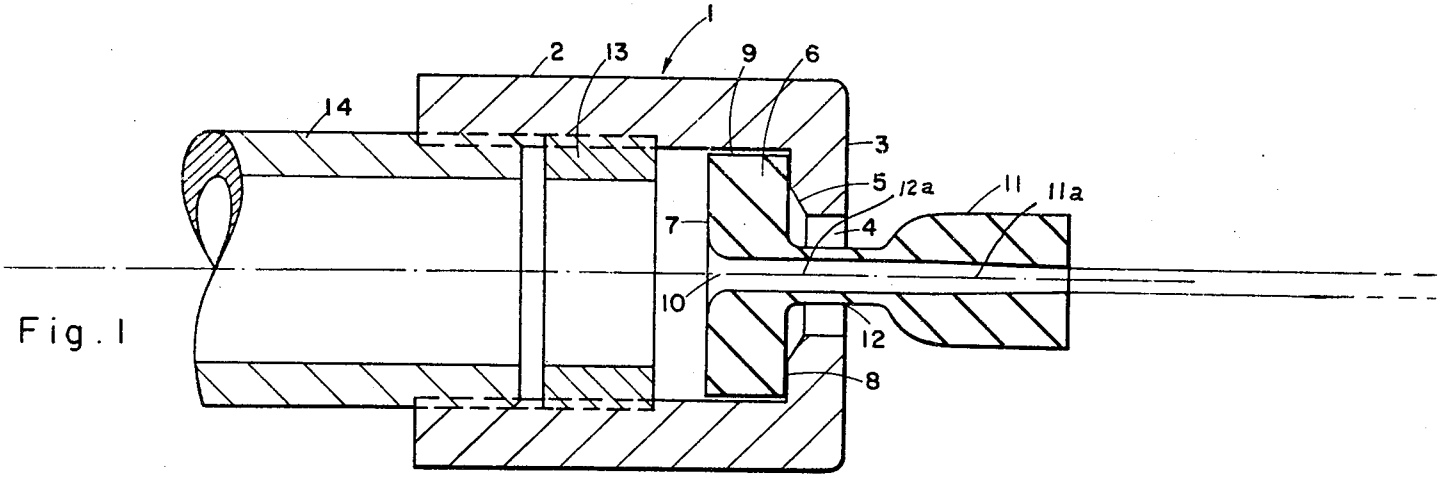

This invention relates to an irrigation device and in particular to a water sprinkler device and is particularly concerned with such a device provided with means for minimizing the variations in the water outflow rate with variations in the water inflow pressure.

It has been proposed to use, for this purpose, an annular flow control valve incorporated in the sprinkler device and comprising an annular member of a resilient material having a flexible orifice through which the liquid is adapted to flow, said liquid flow serving to deform the member so that the area of the orifice varies inversely with the pressure whereby a substantially constant flow rate is maintained.

Such flow control valves are known per se, one form of such a flow control valve being the "Dole" flow control disclosed, inter alia, in U.S. Pat. Nos. 2,389,134, 2,454,929, 2,732,859, 2,775,984 and 3,444,897.

U.S. Pat. No. 4,091,996 discloses the use of such a flow control valve in a water sprinkler wherein the resilient annular member is incorporated in the outlet nozzle of the sprinkler device, the flow control valve being instrumental in ensuring a substantially constant water outflow rate, irrespective of variations in water inflow pressure. In accordance with this prior proposal the orifice of the annular member constitutes the sprinkler outlet of the device and the stream velocity of the outflowing water varies and this can lead to undesirable variations in the distribution of the sprayed water with an installation having water sprinklers at fixed locations, the overlapping radii of which vary with variations in stream velocity.

It is an object of the present invention to provide a new and improved water sprinkler device in which the above referred to disadvantage is substantially reduced or avoided.

According to the present invention there is provided a water sprinkler device having a nozzle housing and an outlet aperture of said housing; a nozzle unit comprising, a resiliently flexible annular member; a resiliently flexible intermediate tubular portion and a nozzle outlet tube, said annular member merging continuously with the outlet tube via said intermediate tubular portion and defining with the outlet tube and the intermediate tubular portion a continuous bore, said outlet tube extending through said outlet aperture, said annular member being located within said housing so as to abut a rim of the outlet aperture.

The provision of the nozzle outlet tube which is integrally formed with the resiliently flexible annular member and which can, if desired, be interiorly finned and/or formed with a tapering bore, ensures that the water emerging from the nozzle does so, not only at a substantially constant rate (as a consequence of the flexing of the annular member and the consequent variation in diameter of its bore in response to the pressure variations of the water flow) but also at a substantially uniform velocity with minimal turbulence. It will be realised that in order to achieve this, the length of the nozzle tube should be a multiple of the width of the bore, the greater the length the more effective is the nozzle tube in overcoming such velocity deviations, etc.

By virtue of the fact that the nozzle tube merges with the annular member via a resiliently flexible intermediate portion there is an unbroken streamlined flowpath through the bore and the flexing of the annular member is accompanied by corresponding flexing of the flexible intermediate portion without the introduction of the discontinuities in the flowpath. By thus ensuring that the flowpath from the orifice to the nozzle outlet is continuously streamlined the water outflow is not only of substantially uniform outflow rate but is also of otherwise uniform characteristics and emerges with minimal pressure losses.

Figure 2:
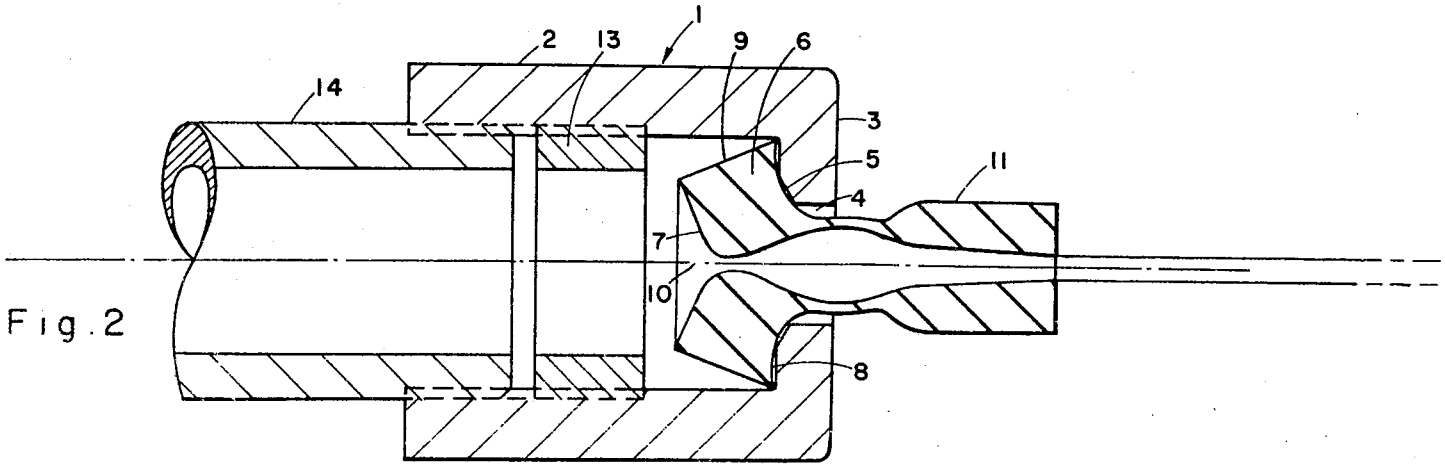
Figure 3:
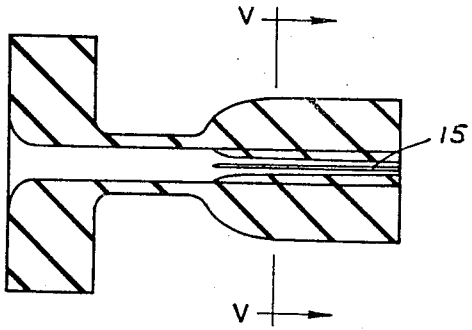
Figure 4:
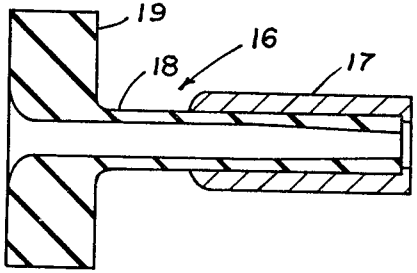
Figure 5:
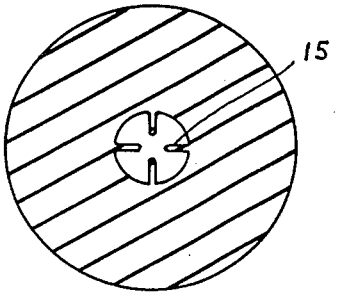

For a better understanding of the present invention and to show how the same may be carried out in practice, reference will now be made to the accompanying drawings in which:

FIG. 1 is a longitudinally sectioned view of a nozzle unit for a water sprinkler device in accordance with the present invention, FIG. 2 is a longitudinally sectioned view of the same unit under the influence of throughflowing water pressure, FIGS. 3 and 4 are respective longitudinally sectioned side elevations of further embodiments of nozzle units in accordance with the present invention, and FIG. 5 is a cross-sectional view of the unit shown in FIG. 3 taken along the line V—V.

As seen in FIG. 1 of the drawings a water sprinkler device includes a nozzle housing 1 having a cylindrical side wall 2 and a centrally apertured end wall 3 in which is formed a central aperture 4, the end wall 3 having an inner bevelled rim 5 suitably of fustroconical configuration as shown.

A nozzle unit comprises an annular member 6 formed of rubber and having a pair of planar end surfaces 7 and 8 and a cylindrical side surface 9 and being located in the nozzle housing 1 with the end face 8 adjacent the bevelled rim 5. The annular member 6 has defined therein, a central, throughgoing bore 10. Formed integrally with the annular member 6 is a nozzle outlet tube 11 which merges with the member 6 via a tubular neck portion 12 of lesser thickness than that of the nozzle tube 11, the tubular neck portion 12 being therefore substantially more resiliently flexible than the nozzle outlet tube 11 and constituting an intermediate portion.

As can be seen from FIG. 1 of the drawings the tubular nozzle outlet tube 11 and the flexible portion 12 have throughgoing bores **11*a* and 12*a* which extend continuously and uniformly from the bore 10 to an outlet, the bore 11*a*** tapering towards this outlet.

The nozzle housing 1 is internally threaded and accommodates an internal retained ring 13 and has fitted thereto a flow pipe 14.

In use, water flowing to the nozzle outlet tube via the supply pipe 14 emerges out of the outlet of the nozzle tube 11. As the water supply pressure tends to rise the annular member 6 deforms with the end face 8 pressing against the bevelled rim 5 and the cylindrical side face 9 sloping inwardly from the inner face of the housing 1 in a manner as shown in FIG. 2 of the drawings so that the bore 10 thereof reduces in area inversely with the rise in pressure and in this way a substantially constant flow rate through the unit is achieved. As can be seen in FIG. 2 of the drawings the provision of the flexible neck portion 12 facilitates the deformation of the annular member 6 and the bore **12*a* of the central neck portion 12 bellows outwardly so as to merge, on the one hand, with the restricted bore 10 and on the other hand with the substantially invariant bore 11*a* of the nozzle tube 11. Thus, as can be seen, the bore 10 and bores 11*a* and 12*a*** continuously merge with each other and are streamlined in shape without any disturbing discontinuities.

The integrally formed nozzle outlet tube ensures that the achievement of a constant outflow rate by virtue of the provision of the annular member is also accompanied by a substantially constant outflow velocity.

In the embodiment shown in FIGS. 3 and 5 of the drawings the nozzle outlet tube is formed with internal axially directed fins 15 which serve to straighten the flow reducing any tendency to turbulence.

In the embodiment shown in FIG. 4 of the drawings the nozzle tube 16 is of uniform thickness but whereas the major end portion thereof is formed with a rigid outer sleeve 17, the portion 18 thereof adjacent the annular flow control valve 19 constituting an intermediate portion, is not so formed, thereby leaving it sufficiently flexible for the purpose indicated above. In other words, the outlet tubular portion is formed of a flexible inner sleeve which is merely an extension of the intermediate portion, and a substantially rigid sleevelike cladding 17 surrounding the flexible inner sleeve.

Whilst in the embodiments described above the nozzle outlet tube is formed with a bore which tapers towards the nozzle outlet, in certain other embodiments the outlet tube bore is of substantially uniform diameter along its length.

I claim:

1. A water sprinkler device, including a nozzle housing, an aperatured end wall of the housing forming a rim defining an aperture of said housing; and a nozzle unit, said nozzle unit comprising, a resiliently flexible annular portion, a resiliently flexible intermediate tubular portion of substantially lesser wall thickness than that of the annular portion and an outlet tubular portion, said portions forming an integral unit with said annular portion merging continuously with the outlet tubular portion via said intermediate tubular portion and defining with the outlet tubular portion and the intermediate tubular portion a continuous bore, said outlet tubular portion extending through said housing aperture with said rim surrounding said intermediate tubular portion, the outer dimensions of which are less than those of said rim, thereby forming an annular gap, said annular portion being located within said housing so as to abut the rim of the housing aperture said outlet tubular portion being of greater rigidity than said resiliently flexible intermediate tubular portion, said flexible intermediate tubular portion constituting means for deforming radially outwardly at least partially within said annular gap when water pressure of water acting on the annular portion increases.

2. A water sprinkler device, according to claim 1 wherein said resiliently flexible intermediate portion is of reduced thickness as compared with that of the outlet tubular portion.

3. A water sprinkler device according to claim 1 wherein said outlet tubular portion is formed with a bore which tapers towards an outlet thereof.

4. A water sprinkler device according to claim 1 wherein an inner wall of said outlet tubular portion is formed with a plurality of axially directed internal flow straightening ribs.

5. A water sprinkler device according to claim 1, wherein said outlet tubular portion is provided with said greater rigidity than said resiliently flexible intermediate tubular portion by means of said outlet tubular portion comprising a substantially rigid sleevelike cladding surrounding an end portion of an inner sleeve of said outlet tubular portion.

6. A water sprinkler device according to claim 5, wherein said intermediate portion and said inner sleeve of said outlet tubular portion extend continuously from said annular portion and are of substantially uniform outer diameter and resilient flexibility.

7. A water sprinkler device according to claim 1, wherein said rim of said housing defining the aperture of said housing has a frustoconical taper along at least part of its length from the inside of said housing to the outside thereof, the frustoconical taper being wider along the inside of said housing and becoming progressively narrower toward the outside thereof.

8. A water sprinkler device according to claim 1, wherein said end wall of said housing includes a first, outer portion against which a downstream surface of said flexible annular portion bears, and a second inner portion which tapers inwardly in a downstream direction and which terminates in said rim and which is offset in an axial direction with respect to said flexible annular portion.

* * * * *